US007162782B1

(12) United States Patent
Nelson

(10) Patent No.: US 7,162,782 B1
(45) Date of Patent: Jan. 16, 2007

(54) SPRING RETAINER AND INSTALLATION AID

(75) Inventor: Alfred Charles Nelson, Carmel, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 0 days.

(21) Appl. No.: 11/176,637

(22) Filed: Jul. 7, 2005

(51) Int. Cl.
*B23P 19/04* (2006.01)

(52) U.S. Cl. ..... 29/227; 29/225

(58) Field of Classification Search ..... 29/227, 29/270, 238–239, 225, 281.5
See application file for complete search history.

(56) References Cited

U.S. PATENT DOCUMENTS

| | | | | |
|---|---|---|---|---|
| 2,608,409 | A | 8/1952 | Pinkerton | |
| 3,716,239 | A | 2/1973 | Goudreau | |
| 3,971,559 | A | 7/1976 | Diforte, Jr. | |
| 4,827,538 | A | 5/1989 | Heimann | |
| 4,910,849 | A * | 3/1990 | Marshall | 29/239 |
| 5,090,062 | A | 2/1992 | Hochstrasser | |
| 5,093,942 | A | 3/1992 | Lang | |
| 5,095,554 | A | 3/1992 | Gloor | |
| 5,361,431 | A | 11/1994 | Freier et al. | |
| 5,390,695 | A | 2/1995 | Howard | |
| 5,575,424 | A | 11/1996 | Fleischmann | |
| 5,675,847 | A | 10/1997 | Pierre | |
| 5,687,464 | A * | 11/1997 | Marshall | 29/263 |
| 5,758,690 | A | 6/1998 | Humpert et al. | |
| 5,771,934 | A | 6/1998 | Warshawsky | |
| 5,960,832 | A | 10/1999 | Warshawsky | |
| 6,106,027 | A | 8/2000 | Mulvey et al. | |
| 6,148,493 | A * | 11/2000 | Pixley et al. | 29/275 |
| 6,234,192 | B1 | 5/2001 | Esche et al. | |
| 6,250,338 | B1 | 6/2001 | Dempsey | |
| 6,370,713 | B1 | 4/2002 | Bosio | |
| 6,381,770 | B1 | 5/2002 | Raisch | |
| 6,381,774 | B1 | 5/2002 | Wales | |
| 6,738,996 | B1 | 5/2004 | Malek et al. | |
| 6,757,921 | B1 | 7/2004 | Esche | |
| 2002/0185553 | A1 | 12/2002 | Benstead et al. | |
| 2003/0188381 | A1 | 10/2003 | Bosio | |
| 2004/0010848 | A1 | 1/2004 | Esche | |
| 2004/0216789 | A1 | 11/2004 | Benstead et al. | |

FOREIGN PATENT DOCUMENTS

WO WO 2004/099085 A2 11/2004

OTHER PUBLICATIONS

Photos of spring recieved over cardboard tube, known by others prior to Jul. 7, 2005, 3 pages.
Grohe Product Catalog -Lady Lux Cafe Stainless Steel pull-out spray, 33 755, 2004, 4 pgs.

* cited by examiner

*Primary Examiner*—Lee D. Wilson
(74) *Attorney, Agent, or Firm*—Baker & Daniels LLP

(57) ABSTRACT

The invention relates to faucet assemblies having removable components such as hand sprayers and spray heads. More particularly, the invention relates to a method and apparatus for retracting removable components of faucet assemblies.

13 Claims, 9 Drawing Sheets

SPRING RETAINER AND INSTALLATION AID

FIELD OF THE INVENTION

The invention relates to faucet assemblies having removable components such as hand sprayers and spray heads. More particularly, the invention relates to a method and apparatus for retracting removable components of faucet assemblies.

BACKGROUND AND SUMMARY OF THE INVENTION

Conventional sink units such as those used in kitchens and bathrooms generally include a faucet having a delivery spout and at least one valve for controlling hot and cold water supplies. Some faucets include additional features such as removable spray heads that can be extended from the faucet to allow a user to spray items that are difficult to place under the delivery spout of a conventional faucet. Some sinks may also include a removable hand sprayer that is positioned adjacent the delivery spout. The removable hand sprayer can be extended from the sink to allow a user to spray items in or around the sink. Both the removable spray head and the removable hand sprayer allow users to conveniently spray items without placing them directly under the delivery spout of a conventional faucet.

According to an illustrative embodiment of the present invention, an installation tool is configured to support a retraction coil for a sprayer of a sink, the sprayer being coupled to a liquid supply hose. The retraction coil has an inner coil diameter, and the liquid supply hose has an outer hose diameter, wherein the outer hose diameter is less than the inner coil diameter. The installation tool includes a substantially cylindrical tube having an outer tube diameter, an inner tube diameter, and first and second spaced apart ends, the outer tube diameter being less than the inner coil diameter such that the retraction coil is configured to receive the tube. The inner tube diameter is greater than the outer hose diameter such that the tube is configured to slidably receive the supply hose. The first end includes a first retainer configured to support a first end of the retraction coil and the second end includes a second retainer configured to support a second end of the retraction coil.

According to a further illustrative embodiment of the present invention, an installation tool is configured to support a retraction coil for a hose. The installation tool includes a substantially cylindrical tube having an outer wall extending between first and second spaced apart ends and defining a central aperture. A retraction coil has first and second spaced apart ends and is received over the tube. A first retainer is supported by the first end of the tube and is configured to engage the first end of the retraction coil, wherein the first retainer comprises a washer removably coupled to the first end of the tube. The washer includes a flange extending radially outwardly from the outer wall of the tube and a coupling member integrally formed with the washer and configured to couple with the tube. A second retainer is supported by the second end of the tube and is configured to engage the second end of the retraction coil.

According to yet another illustrative embodiment of the present invention, a method of installing a retraction coil on a hose for a faucet assembly is provided. The method includes the steps of providing an installation tube, a retraction coil positioned on the installation tube, and a retainer removably coupled to the tube and configured to support an end of the retraction coil. The method further includes the steps of inserting a free end of the hose through the tube, uncoupling the retainer from the tube, sliding the retainer over the hose to form a stop for the retraction coil, and removing the installation tube from the free end of the hose, leaving the retraction coil positioned around the hose.

BRIEF DESCRIPTION OF THE DRAWINGS

The above-mentioned and other features and objects of this invention, and the manner of attaining them, will become more apparent and the invention itself will be better understood by reference to the following description of embodiments of the invention taken in conjunction with the accompanying drawings, wherein.

Figure 1:
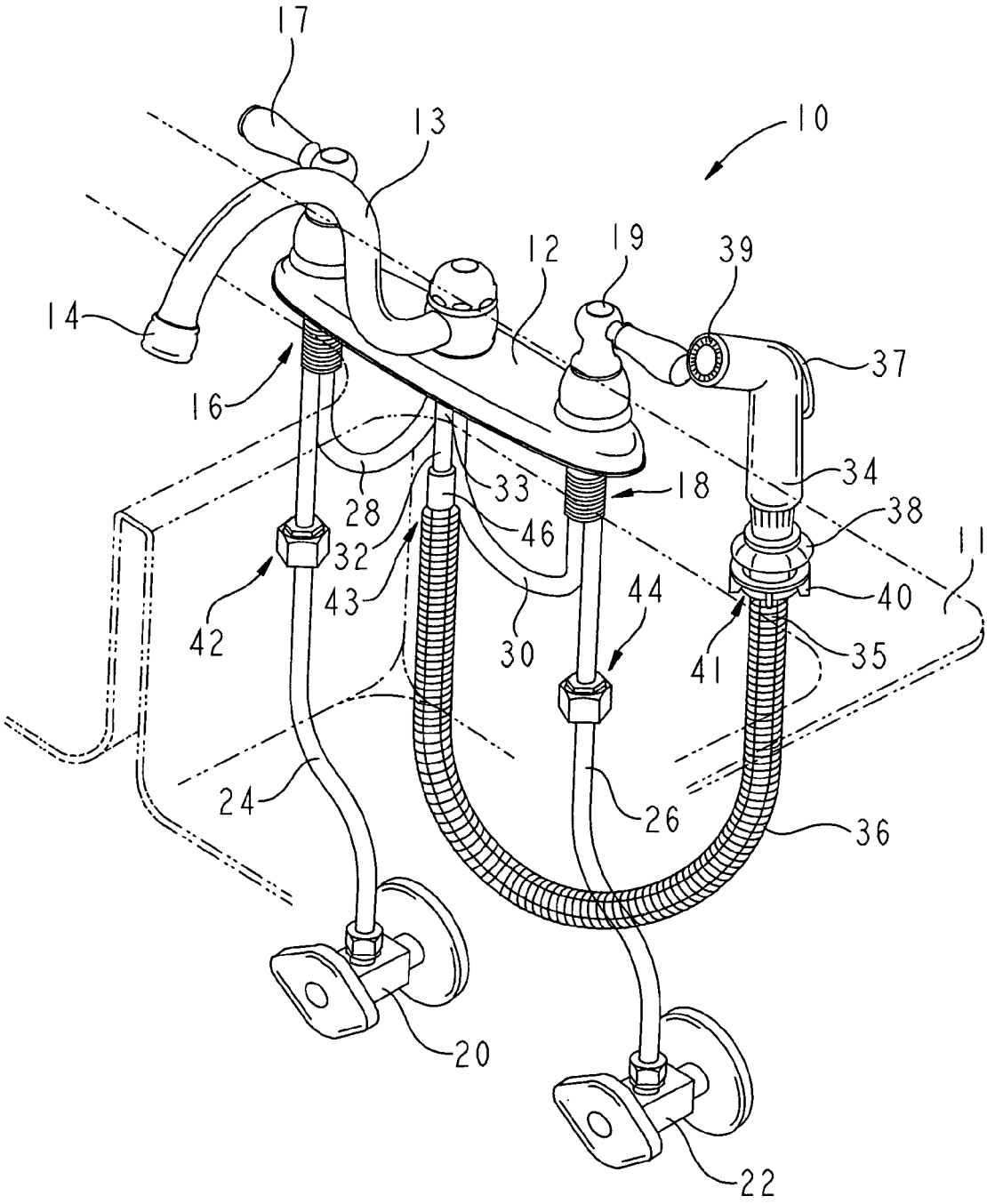
FIG. 1 is a partial perspective view of an illustrative embodiment sink and faucet assembly, with the sink shown in phantom.

Corresponding reference characters indicate corresponding parts throughout the several views. Although the drawings represent embodiments of the present invention, the drawings are not necessarily to scale and certain features may be exaggerated in order to better illustrate and explain the present invention. The exemplifications set out herein illustrate embodiments of the invention in several forms and such exemplification is not to be construed as limiting the scope of the invention in any manner.

DETAILED DESCRIPTION OF THE INVENTION

The embodiments discussed below are not intended to be exhaustive or limit the invention to the precise forms disclosed in the following detailed description. Rather, the embodiments are chosen and described so that others skilled in the art may utilize their teachings.

Figure 2:
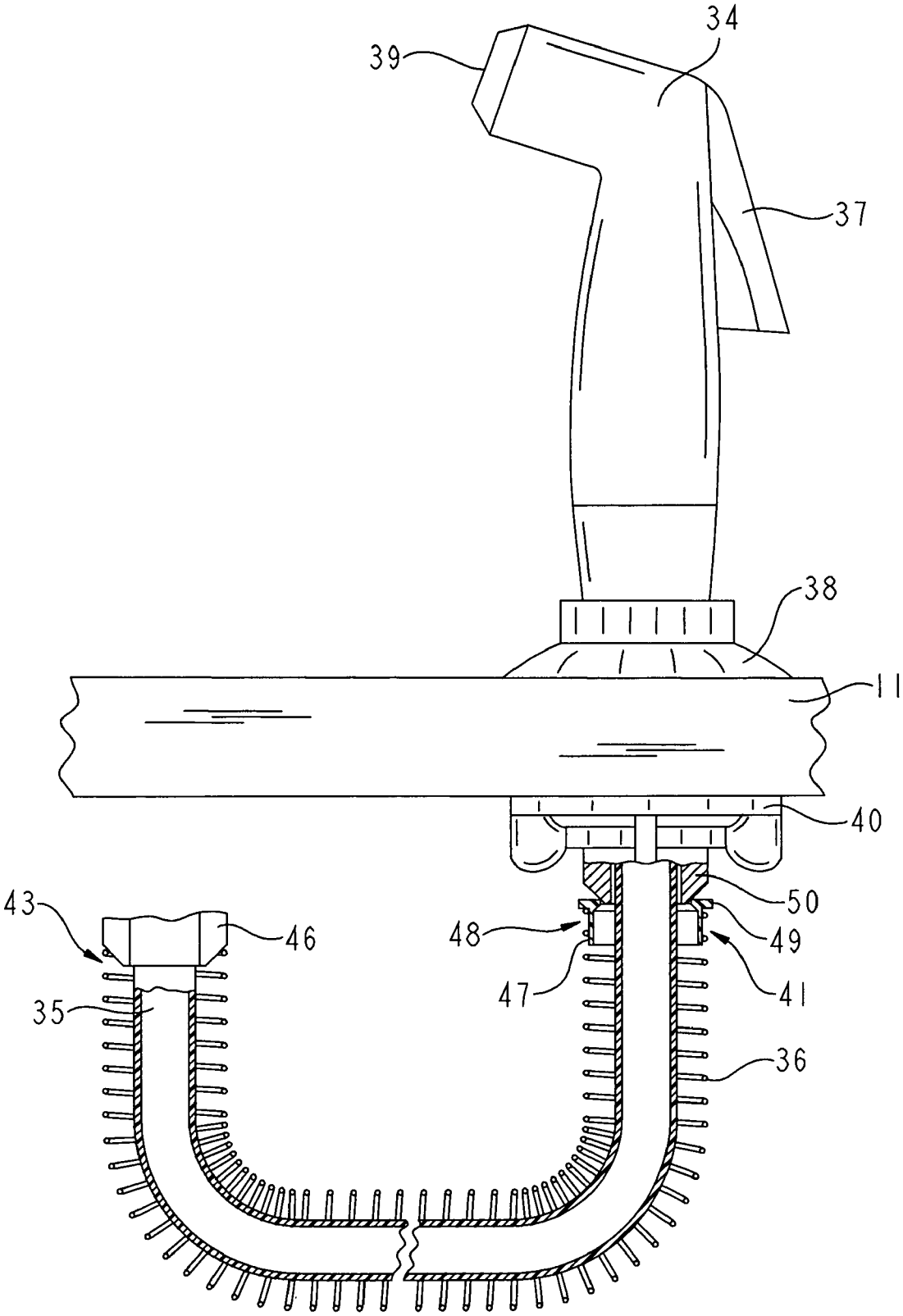
FIG. 2 is a side elevational view, in partial cross-section, of the hand sprayer, supply hose, and retraction coil of the faucet assembly shown in FIG. 1, with the hand sprayer shown in the retracted position.
Figure 3:
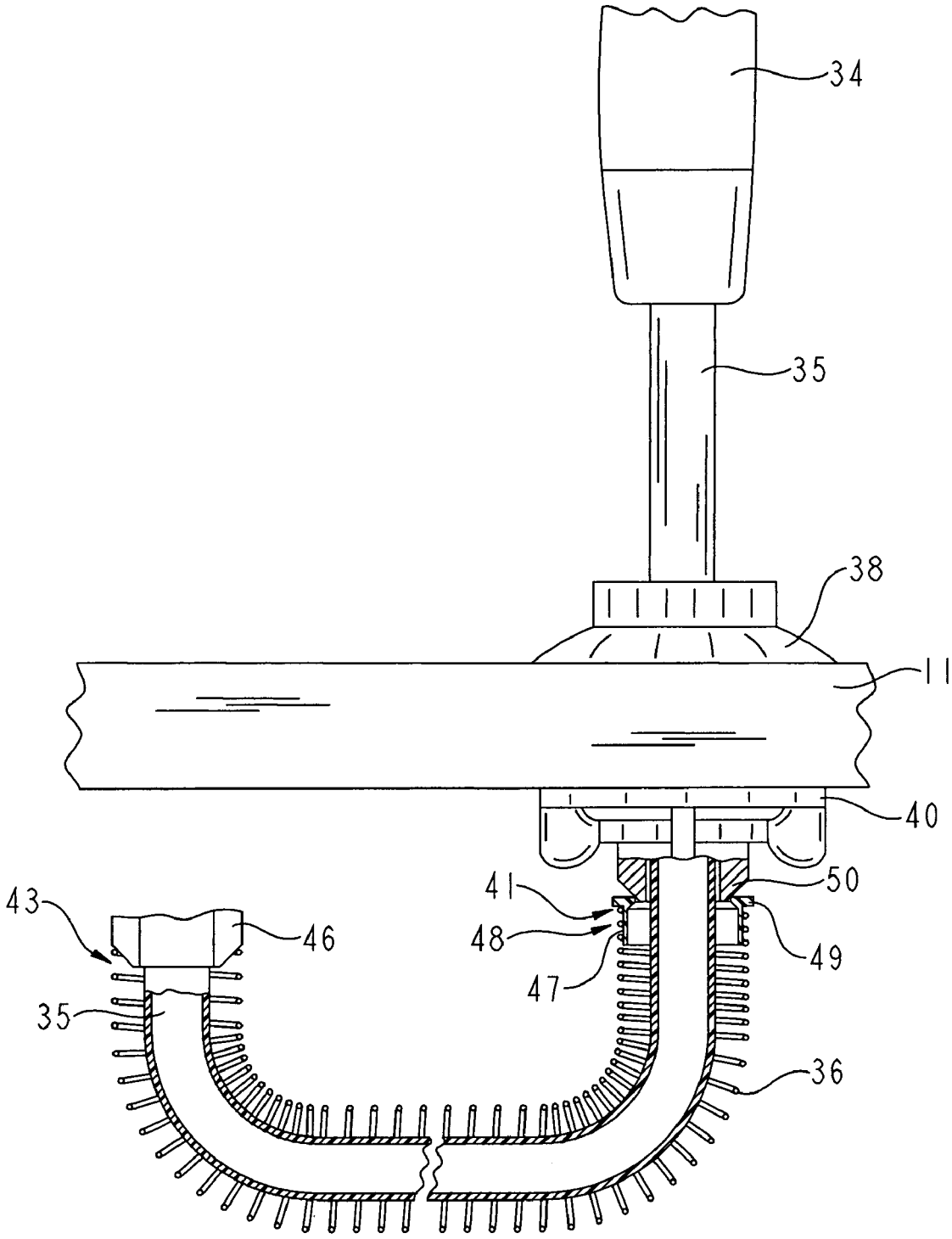
FIG. 3 is a view similar to FIG. 2, with the hand sprayer shown in the extended position.

An illustrative embodiment faucet assembly 10 and sink 11 is shown in FIGS. 1–3. Faucet assembly 10 includes base 12, delivery spout 13, hand sprayer 34, and valve assemblies 16 and 18. Delivery spout 13 is coupled to base 12 and includes an outlet 14, illustratively including an aerator (not shown). Valve assemblies 16, 18 are also coupled to base 12. Valve assembly 16 is coupled to supply line 24 at fluid coupling 42. Supply line 24 carries liquid, illustratively hot water, from shut-off valve assembly 20 to valve assembly 16. Similarly, valve assembly 18 is coupled to supply line 26 at fluid coupling 44. Supply line 26 carries liquid, illustratively cold water, from shut-off valve assembly 22 to valve assembly 18. Hose 28 is coupled between an outlet (not shown) of valve assembly 16 and an inlet (not shown) of delivery spout 13. Similarly, hose 30 is coupled between an outlet (not shown) of valve assembly 18 and an inlet (not shown) of delivery spout 13. Valve assemblies 16 and 18 include handles or levers 17 and 19, respectively, that may be actuated by a user to regulate the flow of water to the delivery spout 13. Moreover, the valve assemblies 16 and 18, delivery spout 13, and couplings therebetween may be of conventional design.

Outlet tube 32 is fluidly coupled on end 33 to hoses 28 and 30 proximate the delivery spout 13. The opposing end of tube 32 is coupled to hose 35 through a fluid coupling 46. The hose 35, in turn, is coupled to removable hand sprayer 34. Hand sprayer 34 may be extended from its original position to allow a user the spray items. Retraction coil 36 is positioned around hose 35 substantially along its length between first and second ends 41 and 43. Retraction coil 36 illustratively comprises a compression spring formed from a continuous run of wire and includes a central aperture. As is known in the art, the compression spring is an open-coil helical spring that offers resistance to a compressive force applied axially. When a user extends hand sprayer 34 by pulling it upward, retraction coil 36 is compressed. When the user releases hand sprayer 34, retraction coil 36 expands and retracts hand sprayer 34 to its original position. This process is described in greater detail below.

As shown in FIGS. 1 and 2, the illustrative hand sprayer 34 is positioned in base 38 in its retracted or default position. Base 38 is mounted to or formed in sink 11. Hand sprayer 34 includes spray head 39, lever 37, and an internal valve assembly (not shown) actuated by lever 37 to control water flow through hand sprayer 34. Base 38 includes a lower end 50 that extends below sink 11. A fastener 40, such as a nut, is positioned below sink 11 on end 50 of base 38 to couple base 38 to sink 11. Both fastener 40 and base 38 include a central aperture having an inner diameter larger than the outer diameter of hose 35 to allow hose 35 to pass through both fastener 40 and base 38 during removal and retraction of hand sprayer 34. In other embodiments (not shown), base 38 and hand sprayer 34 may be mounted in a countertop or any other suitable supporting surface positioned around the faucet. The hand sprayer 34 and base 38 may be of the type known in the art.

During operation of faucet assembly 10, valve assemblies 20 and 22 are positioned in an open position to allow water to flow from a water source (not shown) such as a water heater or other conventional plumbing to valve assemblies 16 and 18. A user moves levers 17 and 19 to actuate valve assemblies 16 and 18, respectively. Water then passes through hoses 28 and/or 30 to the inlet (not shown) of delivery spout 13. Water from the inlet then travels through delivery spout 13 and exits faucet assembly 10 via spray head 14. The user can move levers 17 and 19 to actuate valve assemblies 16 and 18, respectively, to adjust the flow rate and water temperature of the water exiting spray head 14.

Hand sprayer 34 is shown in the retracted position in FIG. 2, and in the extended or removed position in FIG. 3. A retaining washer 48 having a central aperture with a diameter larger than the outer diameter of hose 35 is positioned on hose 35 between retraction coil 36 and lower end 50 of base 38. Washer 48 is illustratively formed of a thermoplastic material, but may comprise any other suitable material. Washer 48 includes a body portion 47 and a radially outwardly extending flange or rim 49. Flange 49 has an outer diameter greater than the inner diameter of retraction coil 36 such that the washer 48 serves as a first stop for the coil 36. More particularly, flange 49 is positioned between first end 41 of retraction coil 36 and lower end 50 of base 38. Body portion 47 of washer 48 extends inside retraction coil 36. The opposing second end 43 of retraction coil 36 abuts fluid coupling 46 of tube 32. Fluid coupling 46 has an outer diameter larger than the inner diameter of retraction coil 36, thereby defining a second stop for the coil 36.

In operation, the user lifts or removes hand sprayer 34 from base 38, as shown in FIG. 3, and depresses lever 37 which actuates the internal valve assembly (not shown). Water then flows from end 46 of hose 28 to spray head 39 of hand sprayer 34. As shown in FIG. 3, when hand sprayer 34 is lifted from base 38, a length of hose 35 is extended through sink 11 and, as such, passes through base 38, fastener 40, end 50, washer 48, and retraction coil 35. As shown in FIGS. 1 and 2, when hand sprayer 34 is in the retracted position, i.e., sitting in base 38, hose 35 is hanging under sink 11 in a relaxed configuration and retraction coil 36 is uncompressed. When hand sprayer 34 is removed from base 38, retraction coil 36 is compressed between coupling 46 of tube 32 and washer 48, as shown in FIG. 3. When the user releases hand sprayer 34, retraction coil 36, which was compressed during extension of hand sprayer 34, extends or decompresses to retract hose 35 and hand sprayer 34 and return them to the retracted position, as shown in FIG. 2.

Figure 4:
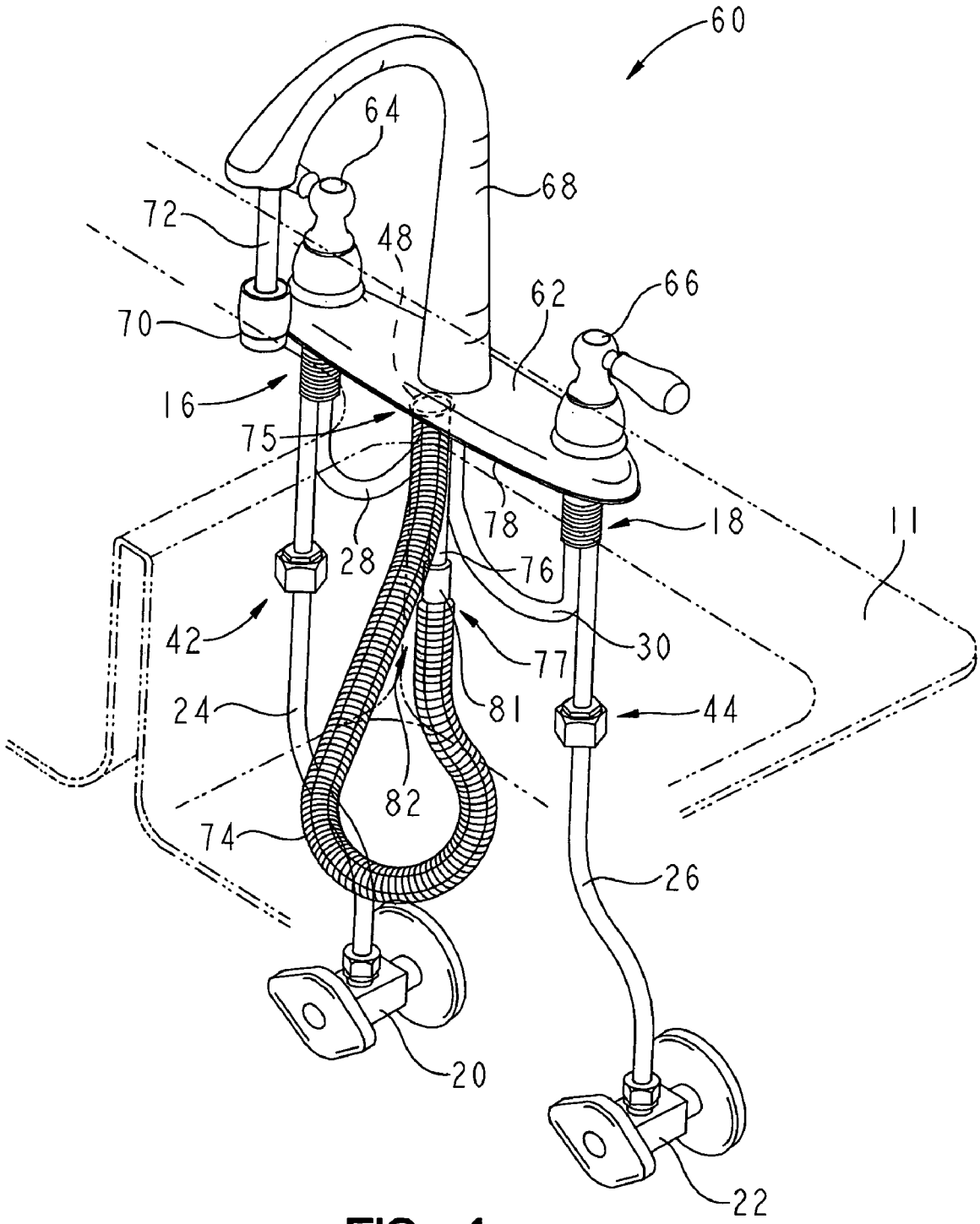
FIG. 4 is a partial perspective view of a further illustrative embodiment sink and faucet assembly, with the sink shown in the phantom.

Another illustrative embodiment faucet assembly is shown in FIG. 4. In the following description like reference numbers refer to similar components as detailed above with respect to the illustrative embodiment of FIG. 1. Faucet assembly 60 includes a base 62, a delivery spout 68, a spray head 70, and levers 64 and 66. Levers 64 and 66 are coupled to valve assemblies 16 and 18 to control the flow of hot and cold water, respectively, to spray head 70. Spray head 70 is fluidly coupled to hose 72 which extends through delivery spout 68 to water outlet tube 76. Retraction coil 74, which is similar to retraction coil 36, discussed above, is positioned around hose 72. Retraction coil 74 includes a central aperture having an inner diameter larger than the outer diameter of hose 72, thereby allowing hose 72 to slidably move within retraction coil 74. A first end 75 of retraction coil 74 abuts the washer 48 which, in turn, abuts a lower surface 78 of the sink 11. The opposing second end 77 of retraction coil 74 abuts the fluid coupling 81 of tube 76. A user may remove or pull spray head 70 out of delivery spout 68, as shown in FIG. 4. When spray head 70 is extended from delivery spout 68, hose 72 extends through delivery spout 68 and compresses retraction coil 74 between the bottom surface 78 of sink 11 and water outlet tube 76. When the user releases spray head 70, retraction coil 74 extends or decompresses to pull hose 72 and spray head 70 back into the retracted position in delivery spout 68.

Figure 5:
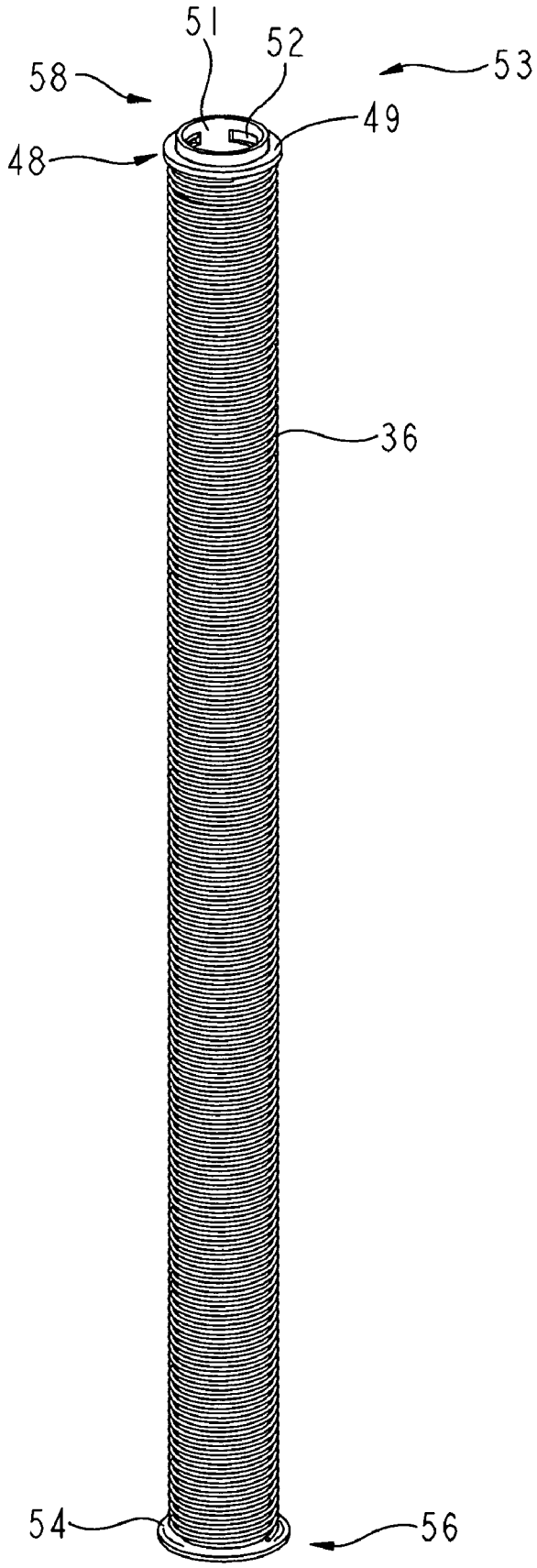
FIG. 5 is a perspective view of an illustrative embodiment installation tool and retraction coil.
Figure 6:
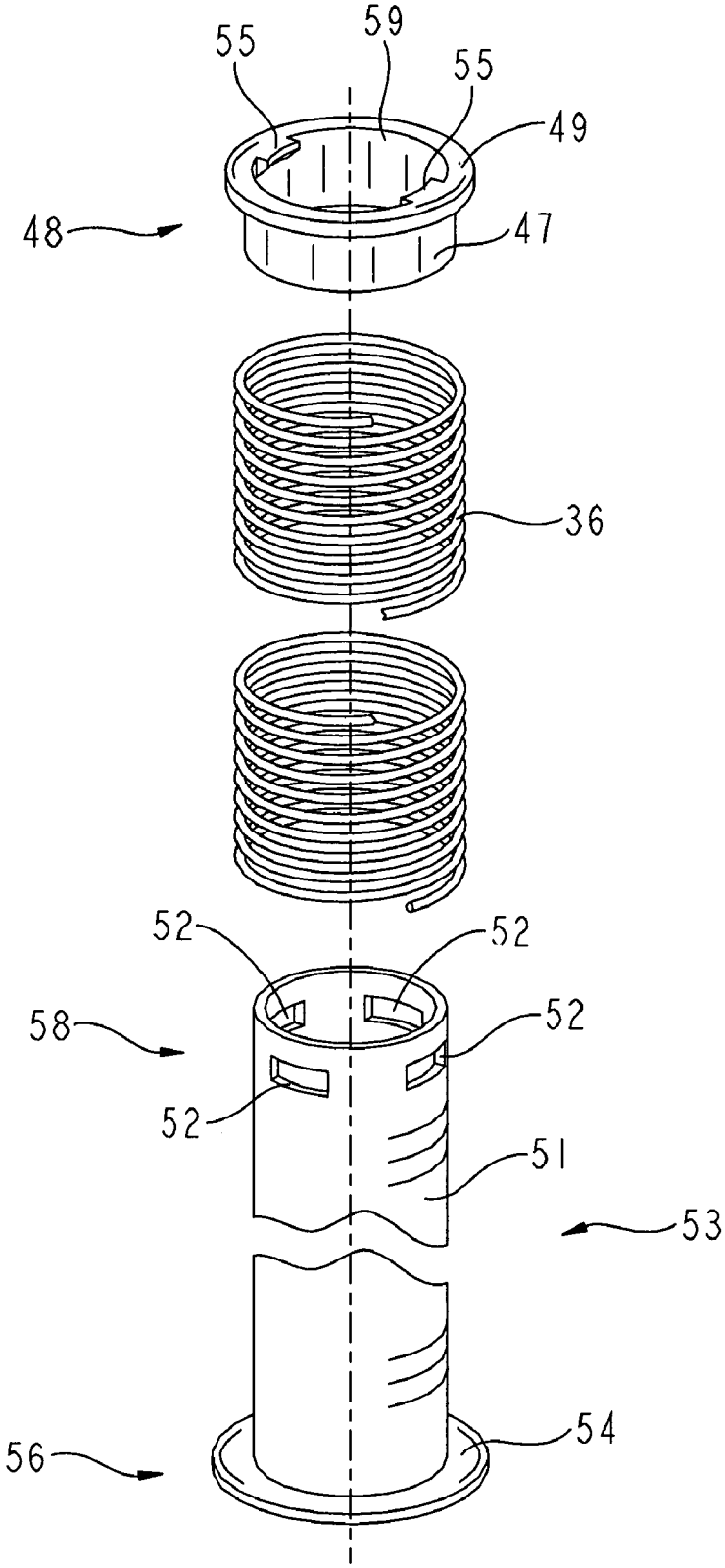
FIG. 6 is a partial exploded perspective view of the installation tool and retraction coil shown in FIG. 5.

FIGS. 5 and 6 illustrate installation tool 53 which is configured to be positioned within retraction coil 36 and to receive the hose 35, 72. Installation tool 53 includes substantially cylindrical tube 51 having an outer wall 57 and a retaining flange 54. Installation tool 53 is illustratively formed from a thermoplastic material, but may comprise any other suitable material. The outer diameter of tube 51 is less than the inner diameter of retraction coil 36, thereby allowing retraction coil 36 to slide on or off of tube 51. A retainer, illustratively flange 54 is formed on lower end 56 of tube 51 and engages or abuts retraction coil 36 when it is positioned on installation tool 53. The outer diameter of flange 54 is greater than the inner diameter of retraction coil 36.

Upper end 58 of tube 51 includes a plurality of apertures or notches 52 positioned around the circumference of tube 51. In this embodiment, a retainer, illustratively washer 48 is coupled to upper end 58 of tube 51, to secure retraction coil 36 on tube 51 (FIG. 5). Washer 48 includes central aperture 59, body 47, and radially outwardly extending flange 49. Washer 48 further includes coupling members, illustratively tabs or extensions 55 which are integrally formed with the body 47. The diameter of aperture 59 is greater than the outer diameter of tube 51 to allow washer 48 to slide over tube 51. Flange 49 extends outwardly from body 47 and has an outer diameter greater than the inner diameter of retraction coil 36. Body 47 of washer 48 has an outer diameter less than the inner diameter of retraction coil 36. Tabs 55 are configured to be received within notches 52 of tube 51 to releasably couple washer 48 to tube 51, as shown in FIG. 5. When retraction coil 36 is positioned on installation tool 53 and washer 48 is coupled to upper end 58 of tube 51, retraction coil 36 encircles body 47 of washer 48 and is compressed between flanges 49 and 54. As such, retraction coil 36 may be stored on installation tool 53 before installation.

In an alternative embodiment (not shown), flange 54 on lower end 56 of tube 51 is replaced with a second removable washer 48 to support the lower end of retraction coil 36. In this embodiment, lower end 56 of installation tool 53 is similar to upper end 58 and includes notches 52 to receive tabs 55 for releasably coupling washer 48 to lower end 56.

Figure 7:
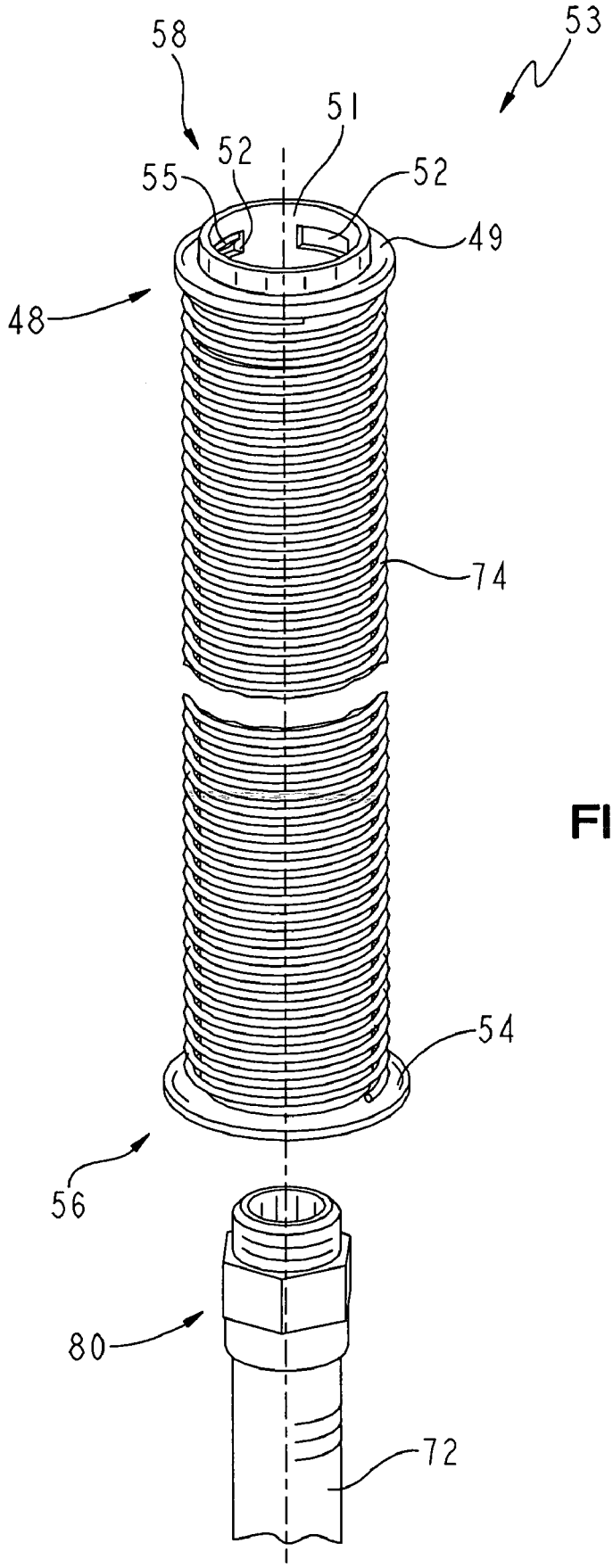
FIG. 7 is a partial perspective view of the installation tool and retraction coil of FIGS. 5 and 6, during an illustrative installation of the retraction coil on a hose.
Figure 8:
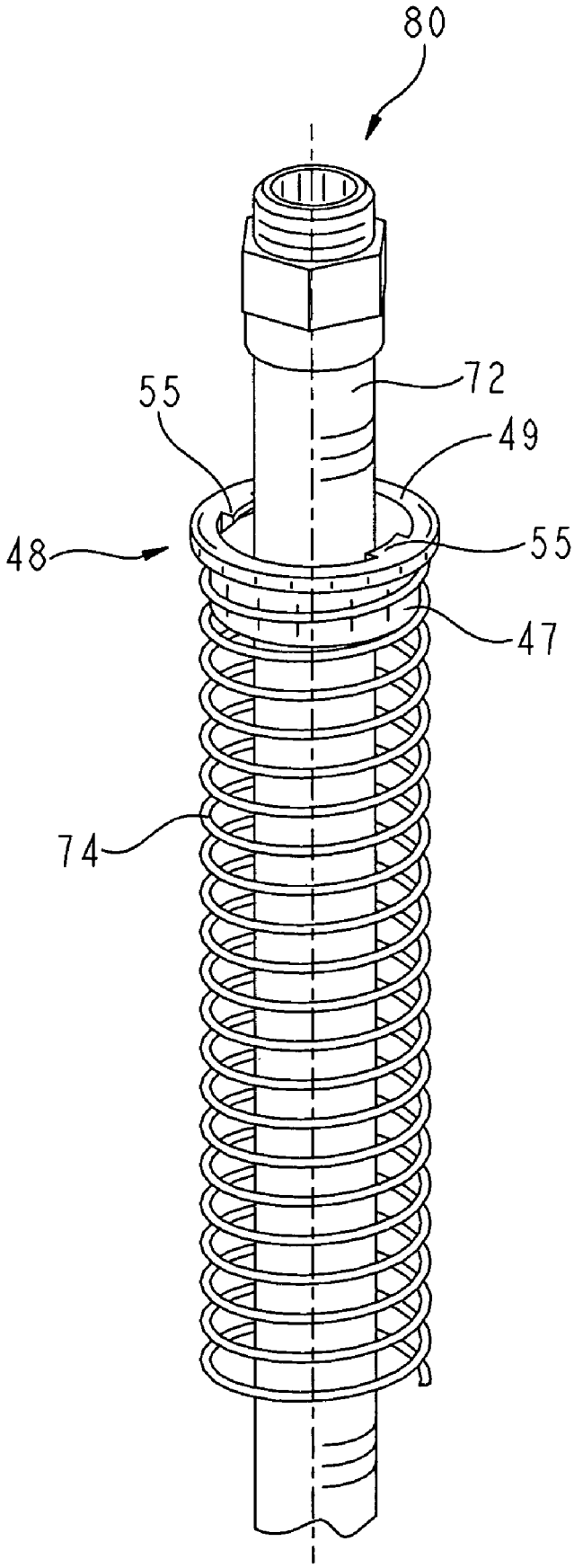
FIG. 8 is a perspective view of the retraction coil of FIGS. 5 and 6 installed on a hose.

FIGS. 7 and 8 illustrate a method of installing retraction coil 74 onto hose 72 using installation tool 53. As detailed above, the inner diameter of tube 51 is greater than the outer diameter of hose 72. To install retraction coil 74, a user aligns first free end 80 of hose 72 with lower end 56 of tube 51. The user then slidably passes hose 72 through the interior of installation tube 51 and couples first free end 80 of hose 72 to spray head 70. Next, the user squeezes washer 48 to remove tabs 55 from notches 52 and slides washer 48 off of tube 51. The coil 74 automatically expands along the hose 72, pushing the washer 48 to a stop, illustratively the bottom surface 78 of sink 11. The user then removes installation tube 51 from hose 72 by sliding it over hose 72 until the opposing second free end 82 of hose 72 passes through installation tube 51. As the user slides installation tube 51 toward the second free end 82 of hose 72, retraction coil 74 expands and extends along the length of hose 72. After the user removes installation tube 51 from the free end of hose 72, the user connects the second free end 82 to tube 76 through fluid coupling 81. In this configuration, retraction coil 74 is positioned between washer 48 which abuts a bottom surface 78 of the sink 11, such as a countertop, and fluid coupling 81.

Figure 9:
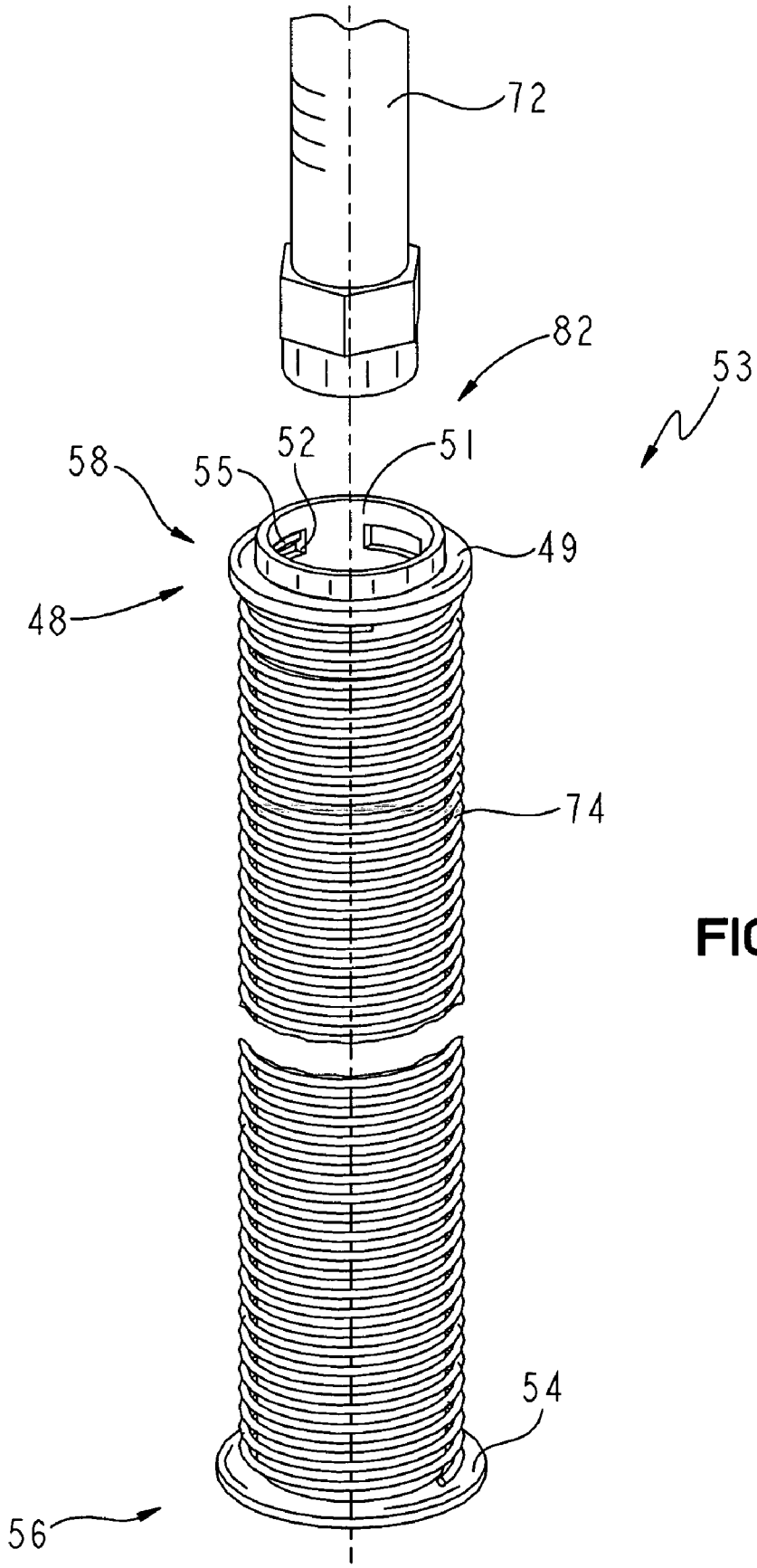
FIG. 9 is a partial perspective view similar to FIG. 7, during a further illustrative installation of the retraction coil on a hose.

As shown in FIG. 9, another method of installing retraction coil 74 may be used to install retraction coil 74 on a hose 72 having only one free or uncoupled end 82. In this case, the first end 80 of retraction coil 74 is illustratively coupled to spray head 70. For this method the user first aligns upper end 58 of installation tube 51 with the free end 82 of the hose 72 and slides the free end 82 through the interior of installation tube 51. The user then removes washer 48, as discussed above, which causes the coil 74 to automatically expand along the length of the hose 72. Next, the user slides installation tube 51 over the free end 82 of the hose 72 leaving retraction coil 74 positioned on the hose 72. The free end 82 of the hose 72 is then coupled to the outlet tube 76 through fluid coupling 81.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An installation tool and liquid supply hose configured to support a retraction coil for a sprayer of a sink, the sprayer coupled to the liquid supply hose, the retraction coil having an inner coil diameter, the liquid supply hose having an outer hose diameter, the outer hose diameter being less than the inner coil diameter, the installation tool including:

a substantially cylindrical tube having an outer tube diameter, an inner tube diameter, and first and second spaced apart ends, the outer tube diameter being less than the inner coil diameter such that the retraction coil is configured to receive the tube, and the inner tube diameter being greater than the outer hose diameter such that the tube slidably receives the supply hose, wherein said substantially cylindrical tube has a through passageway in between the first and second spaced apart ends, the first end including a first retainer configured to support a first end of the retraction coil and the second end including a second retainer configured to support a second end of the retraction coil.

2. The installation tool of claim 1, wherein the first end of the tube includes a plurality of apertures, and the first retainer includes tabs releasably received within the plurality of apertures.

3. The installation tool of claim 1, wherein the second retainer includes a flange extending radially outwardly from the tube.

4. The installation tool of claim 1, wherein the first retainer comprises a washer configured to releasably couple to the tube and engage the retraction coil.

5. The installation tool of claim 4, wherein the removable washer includes a resilient tab configured to engage an aperture within the tube.

6. The installation tool of claim 1, wherein the second retainer comprises a second washer configured to releasably couple to the tube and engage the retraction coil.

7. An installation tool and a liquid supply hose configured to support a retraction coil for the hose, the installation tool and the hose including:

a substantially cylindrical tube having an outer wall extending between first and second spaced apart ends and defining through passageway extending between the first and second spaced apart ends;

a retraction coil having first and second spaced apart ends and received over the tube;

a first retainer supported by the first end of the tube and configured to engage the first end of the retraction coil, wherein the first retainer comprises a washer removably coupled to the first end of the tube, the washer including a flange extending radially outwardly from the outer wall of the tube and a coupling member integrally formed with the washer and configured to couple with the tube; and a second retainer supported by the second end of the tube and configured to engage the second end of the retraction coil.

8. The installation tool of claim 7, wherein the first end of the tube includes a plurality of apertures.

9. The installation tube of claim 8, wherein the coupling member includes a plurality of resilient tabs configured to be releasably received within the plurality of apertures of the tube.

10. The installation tube of claim 7, wherein the second end includes a flange extending radially outwardly from the tube, the flange being configured to contact the retraction coil.

11. The installation tube of claim 7, wherein the washer includes a body portion configured to be concentrically received by the retraction coil.

12. The installation tube of claim 7, wherein the installation tube is formed from a non-metallic material.

13. An installation tool configured to support a retraction coil for a hose, the installation tool including: a substantially cylindrical tube having an outer wall extending between first and second spaced apart ends and defining a central aperture; a retraction coil having first and second spaced apart ends and received over the tube; a first retainer supported by the first end of the tube and configured to engage the first end of the retraction coil, wherein the first retainer comprises a washer removably coupled to the first end of the tube, the washer including a flange extending radially outwardly from the outer wall of the tube and a coupling member integrally formed with the washer and configured to couple with the tube; and a second retainer supported by the second end of the tube and configured to engage the second end of the retraction coil and; wherein the first end of the tube includes a plurality of apertures.

* * * * *